US006638394B2

(12) United States Patent
Mayer et al.

(10) Patent No.: US 6,638,394 B2
(45) Date of Patent: Oct. 28, 2003

(54) METHOD AND APPARATUS FOR DISCHARGE OF WHITEWATER

(75) Inventors: Wolfgang Mayer, Heidenheim (DE); Ralf Rziha, Gerstetten (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/077,253

(22) Filed: Feb. 15, 2002

(65) Prior Publication Data

US 2002/0112837 A1 Aug. 22, 2002

(30) Foreign Application Priority Data

Feb. 16, 2001 (DE) ..... 101 07 328

(51) Int. Cl.[7] ..... D21F 1/60; D21F 7/00

(52) U.S. Cl. ..... 162/190; 162/264; 162/363; 162/380; 162/DIG. 7

(58) Field of Search ..... 162/189–190, 162/264, 55, DIG. 7, 363, 380

(56) References Cited

U.S. PATENT DOCUMENTS

| | | | | | |
|---|---|---|---|---|---|
| 2,893,486 | A | | 7/1959 | Marti | 162/352 |
| 3,266,975 | A | | 8/1966 | Cribben | 162/252 |
| 3,846,233 | A | * | 11/1974 | Kankaanpaa | 162/208 |
| 3,853,696 | A | * | 12/1974 | Uchiyama | 162/308 |
| 3,884,756 | A | * | 5/1975 | Gustafson | 162/299 |
| 3,941,651 | A | * | 3/1976 | Koski | 162/301 |
| 3,951,736 | A | * | 4/1976 | Kobayashi | 162/274 |
| 3,997,390 | A | * | 12/1976 | Kankaanpaa | 162/132 |
| 4,113,556 | A | * | 9/1978 | Kankaanpaa | 162/272 |
| 4,167,441 | A | * | 9/1979 | Keller | 162/290 |
| 4,209,360 | A | * | 6/1980 | Stenberg et al. | 162/203 |
| 4,220,502 | A | * | 9/1980 | Levanen | 162/273 |
| 4,267,017 | A | * | 5/1981 | North | 162/190 |
| 4,477,313 | A | * | 10/1984 | Andersson | 162/123 |
| 4,478,615 | A | * | 10/1984 | Kaiser | 162/190 |
| 4,504,358 | A | * | 3/1985 | Hakansson | 162/264 |
| 4,895,623 | A | | 1/1990 | Corbellini | 162/203 |
| 5,202,000 | A | * | 4/1993 | Phillips | 162/301 |
| 5,468,348 | A | * | 11/1995 | Blackledge et al. | 162/132 |
| 5,851,357 | A | * | 12/1998 | Casale | 162/199 |

FOREIGN PATENT DOCUMENTS

| | | |
|---|---|---|
| AT | 2 93 855 | 10/1971 |
| DE | 1 561 690 | 4/1970 |
| EP | 0 258 918 B1 | 3/1988 |
| WO | WO 99/66121 | 12/1999 |

* cited by examiner

*Primary Examiner*—Jose A. Fortuna
(74) *Attorney, Agent, or Firm*—Taylor & Aust, P.C.

(57) ABSTRACT

In a method and an associated apparatus for discharging the whitewater from inside the loop of a continuous dewatering wire of a former, specifically a twin wire former in a paper machine the accumulating whitewater is collected by a collection tank, which is located within the loop; the collected whitewater is separated from the air, still inside the loop, by suctioning off of the area above the collection tank and the whitewater is removed from the collection tank through at least one channel that is connected to the collection tank and is located below the collection tank's water level.

54 Claims, 1 Drawing Sheet

METHOD AND APPARATUS FOR DISCHARGE OF WHITEWATER

BACKGROUND OF THE INVENTION

1. Field of the Invention

The present invention relates to a method and to an apparatus for the discharge of whitewater that is accumulating inside the loop of a continuous dewatering wire in a former of a paper machine.

2. Description of the Related Art

A method and apparatus for the discharge of whitewater that is accumulating inside the loop of a continuous dewatering wire in a former of a paper machine are known, for example, from prior art documents EP 0 258 918 B1, U.S. Pat. No. 4,895,623, AT-PS 293 855 and U.S. Pat. No. 2,893,486. Hitherto it was generally customary to remove the whitewater that is the result of dewatering in a wire loop from the wire area, together with the air that is transported along with it, through an open trough and to suck the air through exhaust connections from the wire interior and the trough area. This has the disadvantage of a relatively large space requirement outside the machine frame for trough placement and the installation of separators.

SUMMARY OF THE INVENTION

The present invention creates an improved method, as well as an improved apparatus for the discharge of whitewater, whereby the previously mentioned disadvantages are removed.

The present invention provides a method for discharging the whitewater from inside the loop of a continuous dewatering wire of a former, specifically a twin wire former in a paper machine. The whitewater is collected by a collection tank, which is located within the loop. The collected whitewater is separated from the air, still inside the loop, by suctioning off of the area above the collection tank and the whitewater is removed from the collection tank through at least one channel that is connected to the collection tank and is located below its water level.

The accumulating whitewater volume is already being separated from the air inside the wire loop, or the whitewater pan to such an extent that it can be discharged from the machine area through a pipeline which is completely filled with whitewater. The previous space requirement outside the machine frame for trough placement and for the installation of separators is thereby clearly reduced. This results in savings in channels and associated building space requirement. Accordingly, possibilities of standard layouts are created, since the danger of a possible interference with the building is reduced to a minimum. The hitherto required separators adjacent to the paper machine are no longer needed. Another benefit is a simplified frame, since openings in the frame are no longer required for the purpose of whitewater drainage. These advantages are especially positive in twin wire formers.

Preferably a collection tank having as large an area as possible is utilized. The collection tank effectively extends to the two frame sides on the operator and drive side and is presently formed by these two frame sides and the corresponding tie-bars.

According to a preferred practical embodiment of the method in accordance with the present invention, the collection tank is equipped with an at least essentially air-tight hood and this hood is evacuated by an exhaust system, to separate the air from the whitewater that is collected in the collection tank. Appropriately, a hood is used that has no openings along the sides that extend transversely to the direction of travel of the machine. The only openings to the atmosphere are the necessary openings on the relevant dewatering elements on the face of the paper machine.

The whitewater can be stored in the collection tank so that the water level, which is above the channel, is maintained in the collection tank and the whitewater can flow out of the wire area from below this water level.

The flow speed of the whitewater in the exhaust area, or in the area of the collection tank is preferably less than approximately 1 m/s. Specifically, it can be less than approximately 0.5 m/s and preferably less than approximately 0.2 m/s. Such relatively low speeds result in a better exhaust level.

The length of the exhaust area, viewed in direction of machine travel, is longer than approximately 0.5 m. Specifically, it can be longer than approximately 1 m and preferably longer than approximately 2 m.

The length of the exhaust area, viewed in direction of machine travel, can at least essentially be equal to the extent of the collection tank, viewed in direction of machine travel.

According to a preferred practical embodiment of the method according to the present invention the channel which is connected to the collection tank can be open or closed on top. The water level in this channel, which is preferably at least essentially totally filled with whitewater, is lower than the water level in the collection tank.

The whitewater can be discharged laterally from the wire area through the channel which is connected to the collection tank. At least one pipeline may be connected laterally to this channel outside the wire area, through which the whitewater is supplied to a whitewater receptacle located outside the wire area and the former area. The whitewater can then be re-introduced to the process through this whitewater receptacle.

It is advantageous if the inside height or the inside diameter of the pipeline that is at least essentially completely filled with whitewater, is at least essentially identical to the inside height of the channel that is connected to the collection tank.

According to an effective arrangement of the method according to the present invention, the water level in the whitewater reservoir is higher than the water level in the pipeline and in the channel that is connected to the collection tank.

Consistent with another advantageous arrangement of the method according to the present invention at least one channel that is preferably open at the top is connected laterally and outside the wire area to the channel which is connected with the collection tank. The whitewater is supplied through this channel to a whitewater receptacle located outside the wire area and former area. The whitewater can then be re-introduced to the process through this whitewater receptacle.

According to an effective practical arrangement the water level in the channel which is connected to the collection tank is lower than the water levels in the collection tank and the whitewater receptacle.

In certain instances it is also advantageous if the water level in the collection tank is higher than the water level in the whitewater receptacle, and if the water level in this whitewater receptacle is higher than the water level in the channel which is connected to the collection tank.

In principle it is also possible that the water level in the whitewater receptacle is lower than the water level in the collection tank, whereby the level differential is specifically larger than 100 mm and preferably larger than 300 mm.

In addition there is the possibility that outside the wire area at least one pipeline is connected laterally to the channel that is connected with the collection reservoir, through which the whitewater is re-circulated back into the whitewater infeed without passing through a whitewater receptacle. This creates a spatial, as well as a cost advantage in contrast to the presence of a whitewater receptacle through which the whitewater would pass.

It is also advantageous if the flow speed in the channel is faster than 1.2 m/s and preferably faster than 2.4 m/s, whereby its cross-sectional area is smaller than 2 $m^2$ and preferably smaller than 1 $m^2$.

The flow speed in the channel connected to the collection tank through which the whitewater can initially be discharged in transverse direction from the wire area can be adjusted by selecting the difference between the water level in the collection tank and the water level in the whitewater receptacle. Accordingly, arbitrary whitewater quantities can be discharged. This was not possible with previously available devices having open gradients. Since the flow speed in the channel connected to the collection tank is relatively fast, relatively small cross-sectional areas result for the side openings.

The apparatus in accordance with the present invention comprises a collection tank located inside the wire loop. The tank is equipped with an at least essentially airtight hood which can be evacuated through an exhaust system, in order to separate the collected whitewater while still within the wire loop from the air. It is further equipped with at least one channel, connected to the collection tank and located below the tank's water level, for discharging the whitewater from the collection tank.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
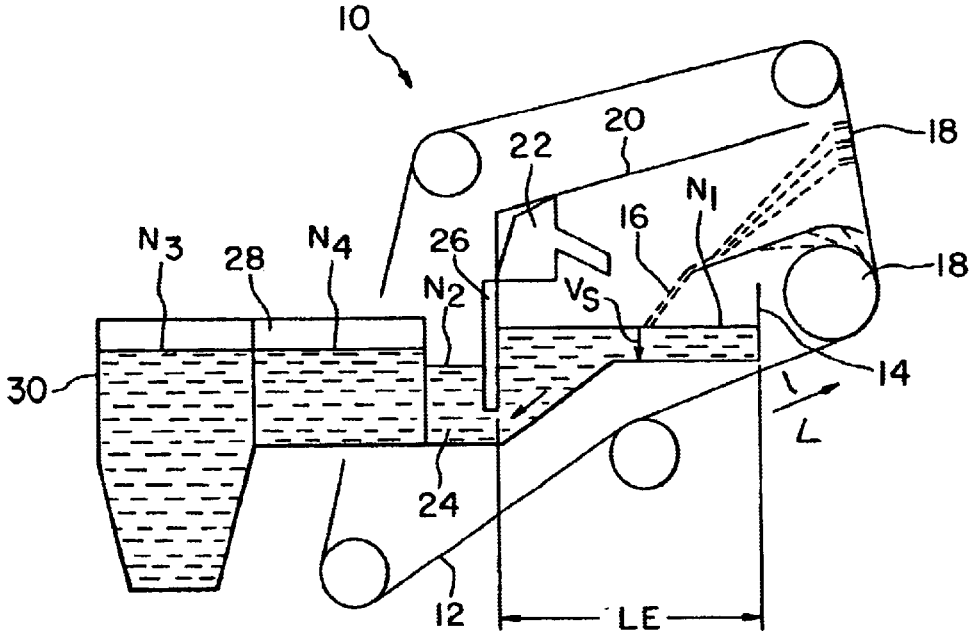
FIG. 1 is a schematic side view representation of a first embodiment of a device for the discharge of whitewater of the present invention that is accumulating inside the loop of a continuous dewatering wire in a twin wire former of a paper machine.
Figure 2:
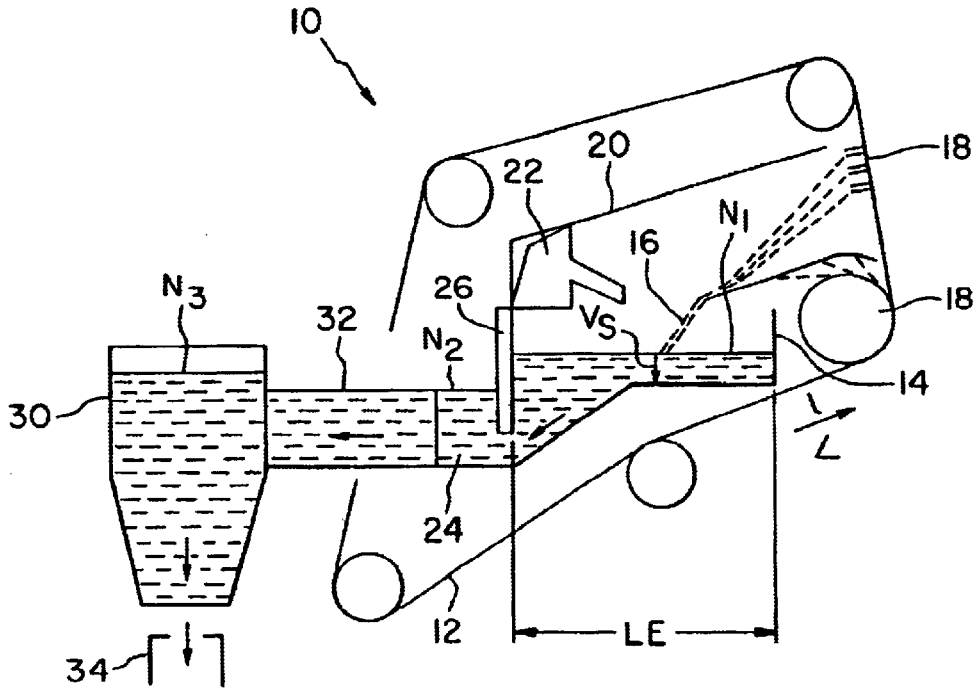
FIG. 2 is a schematic side view representation of another embodiment of the device for the discharge of whitewater of the present invention.

Referring now to the drawings, and more particularly to FIGS. 1 and 2, there is shown two example embodiments of an apparatus 10 for the discharge of whitewater that accumulates inside the loop of a continuous dewatering wire 12 in a former, specifically a twin wire former of a paper machine. Within the wire loop there is a collection tank 14, in which the whitewater 16 that originates from areas equipped with dewatering elements 18 is collected.

The collection tank 14 is equipped with an at least essentially airtight hood 20. This hood 20 can be evacuated through an exhaust system 22, in order to separate the collected whitewater still within the wire loop from the air.

As can be seen from FIGS. 1 and 2, a channel 24 which is located entirely below the water level $N_1$ of the collection tank 14 and through which the whitewater is generally discharged transversely to the direction of machine and wire travel, is connected to the collection tank 14.

The collection tank 14 is configured having a large surface area and may extend to the two frame sides, on the operator and drive side of the paper machine, or may be bordered by these frame sides. The collection tank 14 can therefore, be formed by these frame sides and corresponding tie-bars, the frame sides determining a width of the former, the large surface area therefore being a multiple of the width. As is shown in FIGS. 1 and 2, the floor of the collection tank 14 slopes toward channel 24.

The whitewater is stored in the collection tank 14 with the purpose of maintaining a water level $N_1$ in the collection tank 14, which is above channel 24. The corresponding baffle wall 26 separates the collection tank 14 from the channel 24 which is connected with the collection tank 14 through the open area below the baffle wall 26.

The channel 24 may be open or closed at the top. It is important that the water level $N_2$ is lower in this channel 24, than the water level $N_1$ in the collection tank 14. Channel 24 has a top surface shown in FIGS. 1 and 2 as being approximately coincident with level $N_2$.

The sides of the hood 20 which extend transversely to the direction of machine travel L, should preferably be without openings. The only openings to the atmosphere therefore, are openings which are necessary on the dewatering elements, on the faces of the machine.

The flow speed $V_s$ of the whitewater in the exhaust area, or in the area of the collection tank 14 is preferably less than approximately 1 m/s, thereby achieving a better exhaust level. Specifically, it can be less than approximately 0.5 m/s and preferably less than approximately 0.2 m/s.

The length LE of the exhaust area, viewed in direction of machine travel L, is appropriately longer than approximately 0.5 m. Specifically, it can be longer than approximately 1 m and preferably longer than approximately 2 m. As can be seen in FIGS. 1 and 2, the length LE of the exhaust area, viewed in direction of machine travel L, can at least essentially be equal to the length of the collection tank 14, viewed in direction of machine travel L.

Channel 24 extends laterally from the wire section, in both configurations.

FIG. 1 illustrates a configuration whereby at least one channel 28, having a water level $N_4$, that is preferably open at the top is connected laterally and outside the wire area to the channel 14 which is connected with the collection tank 14. Through this channel 28 whitewater is supplied to a whitewater receptacle 30 located outside the wire area and former area. The whitewater can then be re-introduced to the process through this whitewater receptacle. In this example, the water level $N_4$ in channel 28 is equal to the water level $N_3$ in the whitewater receptacle 30.

In contrast, an example is illustrated in FIG. 2, whereby outside the wire area a pipeline 32 is connected laterally with the channel 24 that is connected with the collection tank 14. In this example, the whitewater is supplied to the whitewater receptacle 30 through this pipeline 32.

The channel 28 provided in the example shown in FIG. 1 may be filled completely, or only partially. However, the pipeline 32 in the example in FIG. 2 is filled completely with whitewater. In the present example, the inside height, or inside diameter of this pipeline 32 is at least essentially identical to the inside height of the channel 24 that is connected to the collection tank 14. As can be seen in FIG. 2, the water level $N_3$ in the whitewater receptacle 30 is higher than the water level in the pipeline 32 and the water level $N_2$ and in the channel 24 which is connected to the collection tank 14. Water from whitewater receptacle 30 passes to a downstream inlet 34 for further processing and/or use.

In both examples, the water level $N_2$ in the channel 24 which is connected to the collection tank 14, is lower than the water levels $N_1$, $N_3$ in the collection tank 14 and the whitewater receptacle 30. Moreover, the water level $N_1$ in the collection tank 14 is higher than the water level $N_3$ in the whitewater receptacle 30.

The above cited level conditions are to be regarded simply as examples. $N_2$ may, for example, be higher than $N_3$, or in the instance of a closed channel 24 may, for example be higher than $N_1$.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a method for discharging whitewater from inside a loop of a continuous dewatering wire of a former, comprising the steps of:

collecting accumulating whitewater by a collection tank which is located within the loop, said collection tank having a collection tank water level;

separating the whitewater from air, still inside the loop, by suctioning off of an area above said collection tank;

removing the whitewater from said collection tank through at least one closed channel which is connected to said collection tank below said collection tank water level, said at least one closed channel has a top surface below said collection tank water level; and adjusting a flow speed of the whitewater in said closed channel by selecting a difference between said collection tank level and a whitewater receptacle water level.

2. The method of claim 1, wherein said collection tank water level has a large surface, the former having a width, said large surface is a multiple of said width.

3. The method of claim 1, wherein said collection tank extends to both frame sides on an operator side and a drive side of the paper machine.

4. The method of claim 1, wherein the whitewater is stored in said collection tank such that said collection tank water level is higher than said at least one closed channel.

5. The method of claim 1, further including said collection tank equipped with an at least essentially air tight hood and that said air tight hood can be evacuated through an exhaust system having an exhaust area above said collection tank said exhaust area having a length, said collection tank having a length, in order to separate the whitewater collected in said collection tank from the air.

6. The method of claim 5, wherein said air tight hood includes sides which extend transversely to a direction of machine travel that are free from openings.

7. The method of claim 5, wherein a flow speed of the whitewater proximate to one of said exhaust area and said collection tank is selected to be less than approximately 1 m/s.

8. The method of claim 7, wherein said flow speed of the whitewater proximate to one of said exhaust area and said collection tank is selected to be less than approximately 0.5 m/s.

9. The method of claim 7, wherein said flow speed of the whitewater proximate to one of said exhaust area and said collection tank is selected to be less than approximately 0.2 m/s.

10. The method of claim 5, wherein said length of said exhaust area is longer than approximately 0.5 m.

11. The method of claim 5, wherein said length of said exhaust area is longer than approximately 1 m.

12. The method of claim 5, wherein said length of said exhaust area is longer than approximately 2 m.

13. The method of claim 5, wherein said length of said exhaust area is at least essentially equal to said length of said collection tank.

14. The method of claim 1, wherein said at least one closed channel that is connected to said collection tank is one of open and closed on top and said at least one closed channel, having an inside height and a channel water level, is filled at least approximately completely with whitewater, said channel water level being lower than said collection tank water level.

15. The method of claim 14, wherein the whitewater is discharged laterally through said at least one closed channel which is connected to said collection tank.

16. The method of claim 15, further including outside an area of the wire a pipeline connected laterally with said at least one closed channel which is connected with said collection tank and that through said pipeline the whitewater is supplied to a whitewater receptacle.

17. The method of claim 16, wherein said pipeline has one of pipeline inside height and pipeline inside diameter, which is filled at least essentially completely with the whitewater, is selected to be at least approximately identical to said inside height of said at least one closed channel that is connected to said collection tank.

18. The method of claim 16, wherein said pipeline has a pipeline water level, said whitewater receptacle has a whitewater receptacle water level higher than both said pipeline water level and said channel water level in said at least one closed channel which is connected to said collection tank.

19. The method of claim 18, wherein said channel water level in said at least one closed channel which is connected to said collection tank is lower than said collection tank water level and said whitewater receptacle water level.

20. The method of claim 18, wherein said collection tank water level is higher than said whitewater receptacle water level and said whitewater receptacle water level is higher than said channel water level.

21. The method of claim 18, wherein said whitewater receptacle water level is lower than said collection tank water level, whereby the differential between said whitewater receptacle water level and said collection tank water level is larger than 100 mm.

22. The method of claim 18, wherein said whitewater receptacle water level is lower than said collection tank water level, whereby the differential between said whitewater receptacle water level and said collection tank water level is larger than 300 mm.

23. The method of claim 16, wherein said at least one closed channel that is open at the top is connected laterally and outside the area of the wire to said pipeline through which the whitewater is supplied to said whitewater receptacle, located outside the area of the wire.

24. The method of claim 16, further including outside the area of the wire at least one pipeline connected laterally to said at least one closed channel, which is connected with said collection tank and through which the whitewater is returned to a whitewater inlet without having to pass through said whitewater receptacle.

25. The method of claim 1, wherein the whitewater in said at least one closed channel has a channel flow speed, said channel flow speed is faster than 1.2 m/s, said at least one closed channel having a channel cross-sectional area smaller than 2 $m^2$.

26. The method of claim 25, wherein said channel cross-sectional area is smaller than 1 $m^2$.

27. The method of claim 25, wherein said channel flow speed is faster than 2.4 m/s.

28. The method of claim 27, wherein said channel cross-sectional area is smaller than 1 $m^2$.

29. A device for discharging whitewater from inside a loop of a continuous dewatering wire of a former, said device comprising:

a collection tank which is located within the loop, said collection tank having a collection tank water level;

an essentially airtight hood located within the loop for separating the collected whitewater from the air;

an exhaust system connected with said hood for suctioning off an area above a water level in said collection tank;

at least one closed channel connected to said collection tank for removing the whitewater from said collection tank, said at least one closed channel being located below said collection tank water level, said at least one closed channel has a top surface below said collection tank water level; and a whitewater receptacle having a whitewater receptacle water level, said whitewater receptacle connected to at least one closed channel, the whitewater having a flow speed in said closed channel, said flow speed adjustable by selecting a difference between said collection tank water level and said whitewater receptacle water level.

30. The device of claim 29, wherein said collection tank water level has a large surface, the former having a width, said large surface is a multiple of said width.

31. The device of claim 29, wherein said collection tank extends to both frame sides on an operator side and a drive side of the paper machine.

32. The device of claim 29, wherein said air tight hood is utilized whose sides which extend transversely to a direction of machine travel are free from openings.

33. The device of claim 29, wherein the whitewater is stored in said collection tank in order to maintain said collection tank water level, which is higher than said at least one closed channel.

34. The device of claim 29, wherein said area above said collection tank is an exhaust area having a length, a flow speed of the whitewater proximate to one of said exhaust area and said collection tank is selected to be less than approximately 1 m/s.

35. The device of claim 34, wherein said flow speed of the whitewater proximate to one of said exhaust area and said collection tank is selected to be less than approximately 0.5 m/s.

36. The device of claim 34, wherein said flow speed of the whitewater proximate to one of said exhaust area and said collection tank is selected to be less than approximately 0.2 m/s.

37. The device of claim 34, wherein said length of said exhaust area is selected to be longer than approximately 0.5 m.

38. The device of claim 34, wherein said length of said exhaust area is selected to be longer than approximately 1 m.

39. The device of claim 34, wherein said length of said exhaust area is selected to be longer than approximately 2 m.

40. The device of claim 34, wherein said length of said exhaust area is selected to be at least essentially equal to said collection tank length.

41. The device of claim 29, wherein said at least one closed channel that is connected to said collection tank is one of open and closed on top with a channel water level and said at least one closed channel is filled at least essentially completely with the whitewater, having said channel water level lower than said collection tank water level.

42. The device of claim 41, wherein inside said loop is a wire area, said at least one closed channel which is connected to said collection tank protrudes laterally from the wire area.

43. The device of claim 42, further including outside the wire area a pipeline connected laterally with said at least one closed channel having an inside height which is connected with said collection tank and that through said pipeline the whitewater is supplied to a whitewater receptacle which is located outside the wire area, said pipeline having a pipeline water level.

44. The device of claim 43, wherein said at least one closed channel that is open at the top is connected laterally and outside the wire area to said pipeline through which the whitewater is supplied to said whitewater receptacle, located outside the wire area.

45. The device of claim 43, wherein said pipeline has one of pipeline inside height and pipeline inside diameter, which is filled at least essentially completely with the whitewater, is selected to be at least essentially identical to said inside height of said at least one closed channel that is connected to said collection tank.

46. The device of claim 45, wherein said whitewater receptacle has a whitewater receptacle water level higher than both said pipeline water level and said channel water level in said at least one closed channel which is connected to said collection tank.

47. The device of claim 46, wherein said channel water level in said at least one closed channel which is connected to said collection tank is lower than both said collection tank water level and said whitewater receptacle water level.

48. The device of claim 46, wherein said collection tank water level is higher than said whitewater receptacle water level and said whitewater receptacle water level is higher than said channel water level.

49. The device of claim 46, wherein said whitewater receptacle water level is lower than said collection tank water level, whereby the differential between said whitewater receptacle water level and said collection tank water level is larger than 100 mm.

50. The device of claim 46, wherein said whitewater receptacle water level is lower than said collection tank water level, whereby the differential between said whitewater receptacle water level and said collection tank water level is larger than 300 mm.

51. The device of claim 29, wherein the whitewater in said at least one closed channel has a channel flow speed, said channel flow speed is faster than 1.2 m/s, said at least one closed channel having a channel cross-sectional area, said channel cross-sectional area being smaller than 2 $m^2$.

52. The device of claim 51, wherein said channel cross-sectional area is smaller than 1 $m^2$.

53. The device of claim 51, wherein said channel flow speed is faster than 2.4 m/s.

54. The device of claim 53, wherein said channel cross-sectional area is smaller than 1 $m^2$.

* * * * *